US010549144B2

(12) United States Patent
Kuo

(10) Patent No.: US 10,549,144 B2
(45) Date of Patent: Feb. 4, 2020

(54) HAND-FOOT COMPOSITE MOTION EXERCISE MACHINE

(71) Applicant: SportsArt Industrial Co., Ltd., Tainan (TW)

(72) Inventor: Hai-Pin Kuo, Tainan (TW)

(73) Assignee: SPORTSART INDUSTRIAL CO., LTD., Tainan (TW)

( * ) Notice: Subject to any disclaimer, the term of this patent is extended or adjusted under 35 U.S.C. 154(b) by 143 days.

(21) Appl. No.: 15/920,679

(22) Filed: Mar. 14, 2018

(65) Prior Publication Data

US 2018/0264314 A1 Sep. 20, 2018

(30) Foreign Application Priority Data

Mar. 16, 2017 (TW) ..... 106108801 A

(51) Int. Cl.

| | |
|---|---|
| ***A63B 22/00*** | (2006.01) |
| ***A63B 22/06*** | (2006.01) |
| ***A63B 21/22*** | (2006.01) |
| ***A63B 21/00*** | (2006.01) |
| ***A63B 24/00*** | (2006.01) |
| ***A63B 21/005*** | (2006.01) |

(52) U.S. Cl.

CPC ..... *A63B 22/001* (2013.01); *A63B 21/0058* (2013.01); *A63B 21/22* (2013.01); *A63B 21/4034* (2015.10); *A63B 21/4035* (2015.10); *A63B 21/4047* (2015.10); *A63B 22/0046* (2013.01); *A63B 22/0664* (2013.01); *A63B 24/0087* (2013.01); *A63B 2225/09* (2013.01)

(58) Field of Classification Search

CPC ..... A63B 21/0058; A63B 21/22; A63B 21/4034–4035; A63B 21/4047; A63B 22/001; A63B 22/0046; A63B 22/0664–2022/0688; A63B 22/0015–0023; A63B 22/20–201; A63B 22/208; A63B 24/0087; A63B 71/0622; A63B 2225/09

See application file for complete search history.

(56) References Cited

U.S. PATENT DOCUMENTS

| | | | | |
|---|---|---|---|---|
| 9,186,541 | B1 * | 11/2015 | Murray | A63B 22/201 |
| 9,873,014 | B1 * | 1/2018 | Kuo | A63B 21/0053 |
| 2013/0244837 | A1 * | 9/2013 | Chen | A63B 22/001 482/52 |
| 2014/0141939 | A1 * | 5/2014 | Wu | A63B 22/001 482/52 |
| 2015/0202488 | A1 * | 7/2015 | Lo | A63B 22/001 482/52 |
| 2015/0375030 | A1 * | 12/2015 | Yang | A63B 21/015 482/52 |

(Continued)

*Primary Examiner* — Jennifer M Deichl
(74) *Attorney, Agent, or Firm* — Sinorica, LLC

(57) ABSTRACT

A hand-foot composite motion exercise machine generally includes a supportive frame, a transmission unit, a crank means, and a pair of linkage units. The exercise machine allows a user to change the configuration of each linkage unit through a raising/lowering device and a displacing device, so as to adjust the motion path of a pedal provided at each linkage unit, and the force required for treading the pedal. In use, while a user steps on the pedals to exercise, each pedal can perform a substantially elliptical closed path, which is ergonomical so that the user can be protected from exercise injury.

6 Claims, 14 Drawing Sheets

(56) References Cited

U.S. PATENT DOCUMENTS

| | | | | |
|---|---|---|---|---|
| 2016/0263427 | A1* | 9/2016 | Mueller | A63B 22/0015 |
| 2018/0185698 | A1* | 7/2018 | Anderson | A63B 21/4034 |
| 2018/0339189 | A1* | 11/2018 | Luger | A63B 21/4034 |

* cited by examiner

HAND-FOOT COMPOSITE MOTION EXERCISE MACHINE

(A) TECHNICAL FIELD OF THE INVENTION

The present invention relates to a hand-foot composite motion exercise machine and, more particularly, to an exercise machine that can adjust the motion path performed by a pedal thereof and can adjust the force required for treading the pedal.

(B) DESCRIPTION OF THE PRIOR ART

A variety of indoor sports equipment can be used to train body muscles, so that a person may perform physical training at home or indoors to achieve the purpose of fitness or rehabilitation. Indoor sports equipment, such as treadmills, stair trainers, rowing machines, exercise bikes and so on, are usually chosen by consumers. Under new technology development, exercise machines with a specific motion trajectory are widely favored by consumers. Although the exercise machines have the effect of physical training, they provide only one movement mode, thus failing to adjust the motion paths. Besides, those machines require users to follow the movement trajectories thereof. If the movement trajectory of an exercise machine is not designed properly, users may feel pain at their feet muscles while using the machine. After using an improperly designed machine for a period of time, exercise injury may result.

SUMMARY OF THE INVENTION

One object of the present invention is to provide a hand-foot composite motion exercise machine, which allows a user to change the configuration of each linkage unit through a raising/lowering device and a displacing device thereof, so as to adjust the motion path of a pedal of each linkage unit and the force required for treading the pedal. Thus, each pedal can perform a substantially elliptical closed path, which is ergonomical so that the user can be protected from exercise injury.

According to one aspect of the present invention, the exercise machine generally comprises a supportive frame, a transmission init, a crank means, and a pair of linkage units. The supportive frame can be placed on a floor or ground. The transmission unit includes a first wheel rotatably mounted at the supportive frame and an electrical generator provided at the supportive frame and driven by the first wheel. The crank means includes a left part, a right part, and an offset bar joined between an inner end of the left part and an inner end of the right part. The left part and the right part are symmetrical about a center of the offset bar. The outer end of the left part is fixed to a center of the first wheel. An outer end of the right part is rotatably connected at the supportive frame. Each linkage init includes a first adjustment link, a second adjustment link, a front link, a rear link, an upper link, a lower curved link, and a pivot block. The first adjustment link includes a hollow link body formed thereunder with a front pivot and a rear pivot, and provided thereon with a connection bracket having a lower roller and an upper roller and capable of being driven by a displacing device to slide along the hollow link body, wherein the lower and upper rollers define a space theretween, which is at a predetermined distance from the front pivot and through which the lower curved link can be inserted. The front pivot of the first adjustment link is in pivotal connection with the crank means. The rear pivot of the first adjustment link is in pivotal connection with a lower end of the rear link. An upper end of the rear link is pivotally connected to the supportive frame. A rear end of the upper link is in pivotal connection with a bottom pivot of the pivot block which is pivotally connected at a top pivot thereof to the supportive frame. The second adjustment link is pivotally connected at a first upper pivot thereof to the supportive frame. A front end of the upper link is in pivotal connection with a second upper pivot of the second adjustment link. A lower end of the second adjustment link is in pivotal connection with a front end of the lower curved link. A rear end of the lower curved link is provided with a pedal. An upper end of the front link is in pivotal connection with a raising/lowering tube provided in the second adjustment link. A lower end of the front link is in pivotal connection with the crank means. The first upper pivot of the second adjustment link and the top pivot of the pivot block of each linkage unit are located respectively at two sides of a vertical axis extending passing through the center of the first wheel. The lower end of the second adjustment link and the pedal are located respectively at two sides of the vertical axis. When a user wants to adjust the motion path of a pedal or the force required for treading the pedal, the first adjustment link and/or the second adjustment link can be adjusted in length.

Other objects, advantages, and novel features of the present invention will become more apparent from the following detailed description when taken in conjunction with the accompanying drawings.

DETAILED DESCRIPTION OF THE PREFERRED EMBODIMENTS

Figure 1:
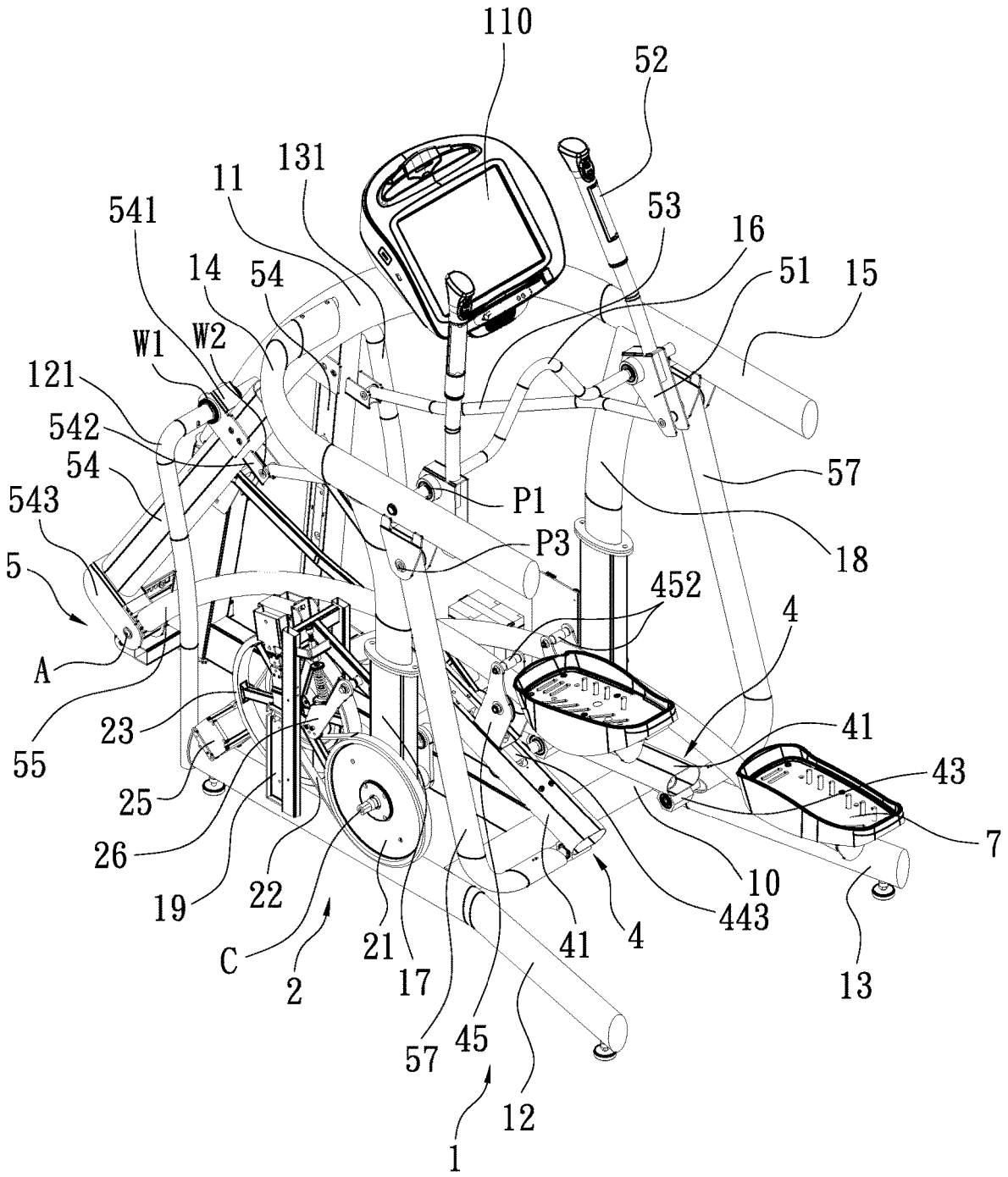
FIG. 1 shows a 3-dimensional view of an exercise machine according to one embodiment of the present invention.
Figure 2:
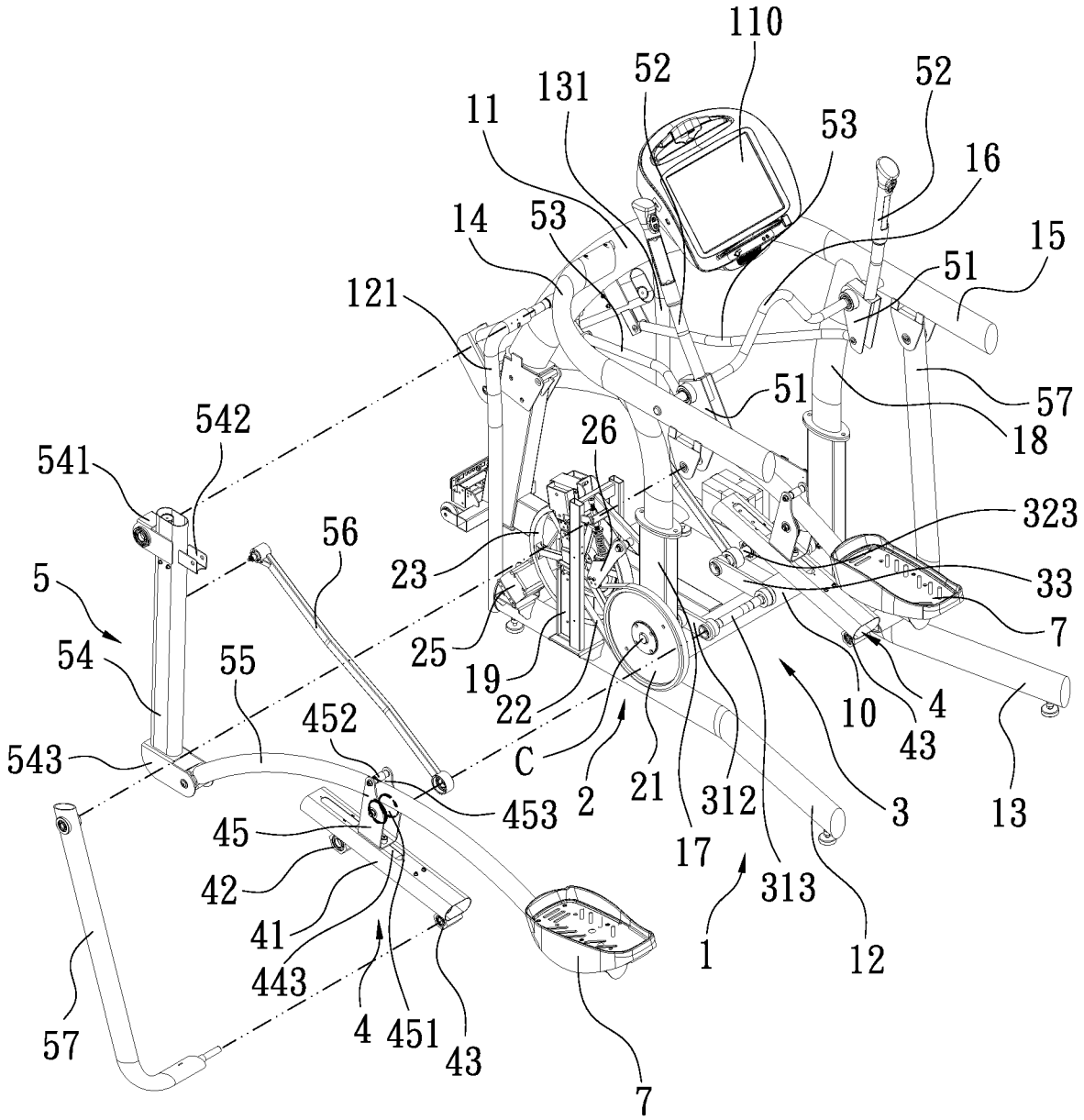
FIG. 2 shows a partially exploded view of the exercise machine.

Referring to FIGS. 1 and 2, a foot-hand composite motion exercise machine according to one embodiment of the present is shown, which generally comprises a supportive frame 1, a transmission unit 2, a crank means 3, and a pair of spaced-apart linkage units 5 each including a first adjustment link 4, a second adjustment link 54, a front link 56, an L-shaped rear link 57, an upper link 53, a lower curved link 55, and a pivot block 51.

The supportive frame 1 can be placed on a floor or ground. The supportive frame 1 is constructed of a base 10 (which is formed of bars), a front post 11 extending upwardly from the base 10, two rearward extension bars 12, 13 extending rearwardly from the base 10, a pair of curved bars 14, 15 extending rearwardly from the front post 11 and located at a predetermined height from the base 10, left and right posts 17, 18 extending upwardly from the base 10 to respectively joined to the pair of curved bars 14, 15, a pair of L-shaped poles 121, 131 extending upwardly from the base 10 and joined to the front post 11, and a transverse pole 16 joined between the pair of curved bars 14, 15. Furthermore, an upright brace 19 is provided on the base 10 of the supportive frame 1, between the left L-shaped pole 121 and the left post 17. A control panel 110, which can show information of exercise activity, is provided on top of the front post 11.

Figure 3:
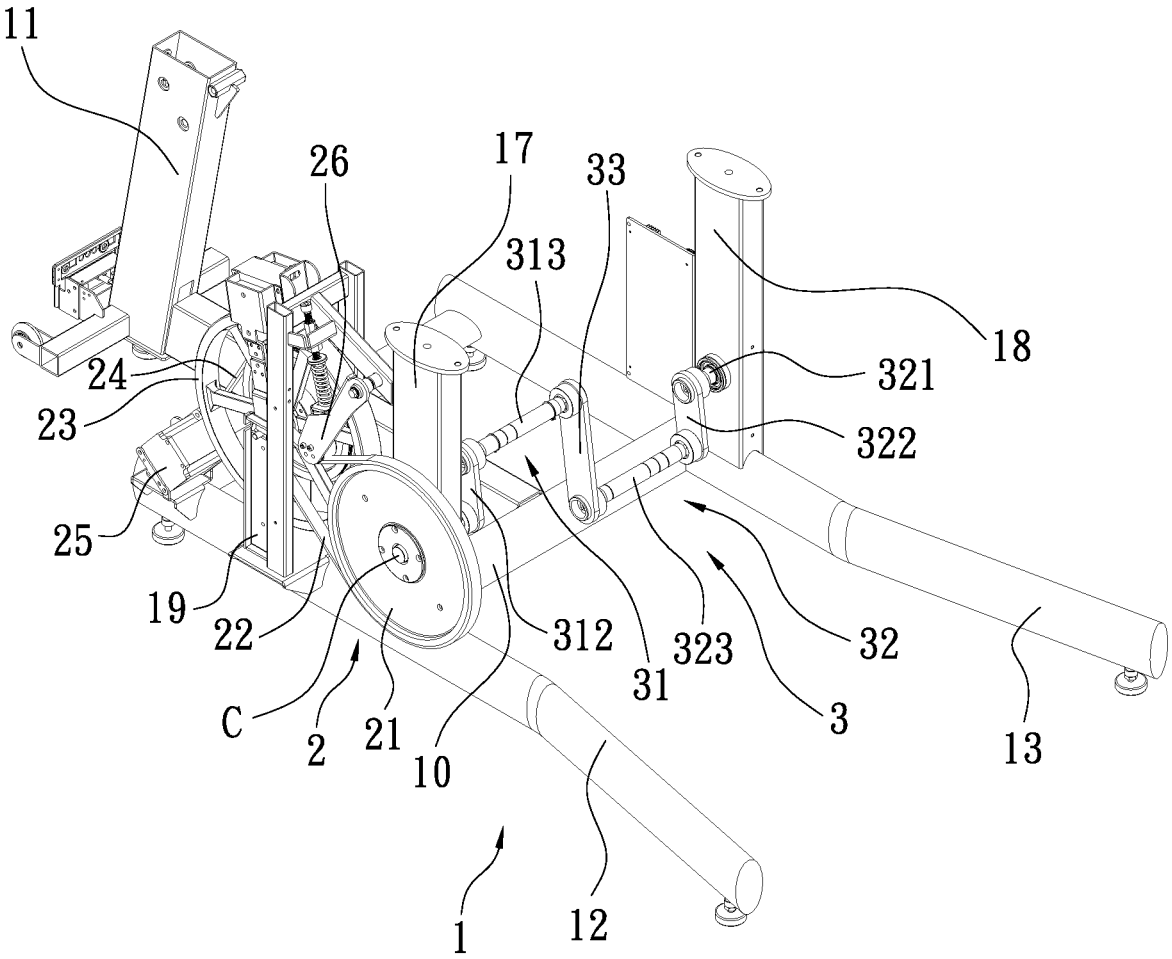
FIG. 3 shows a 3-dimensional view of a supportive frame mounted with a transmission unit in the exercise machine.
Figure 4:
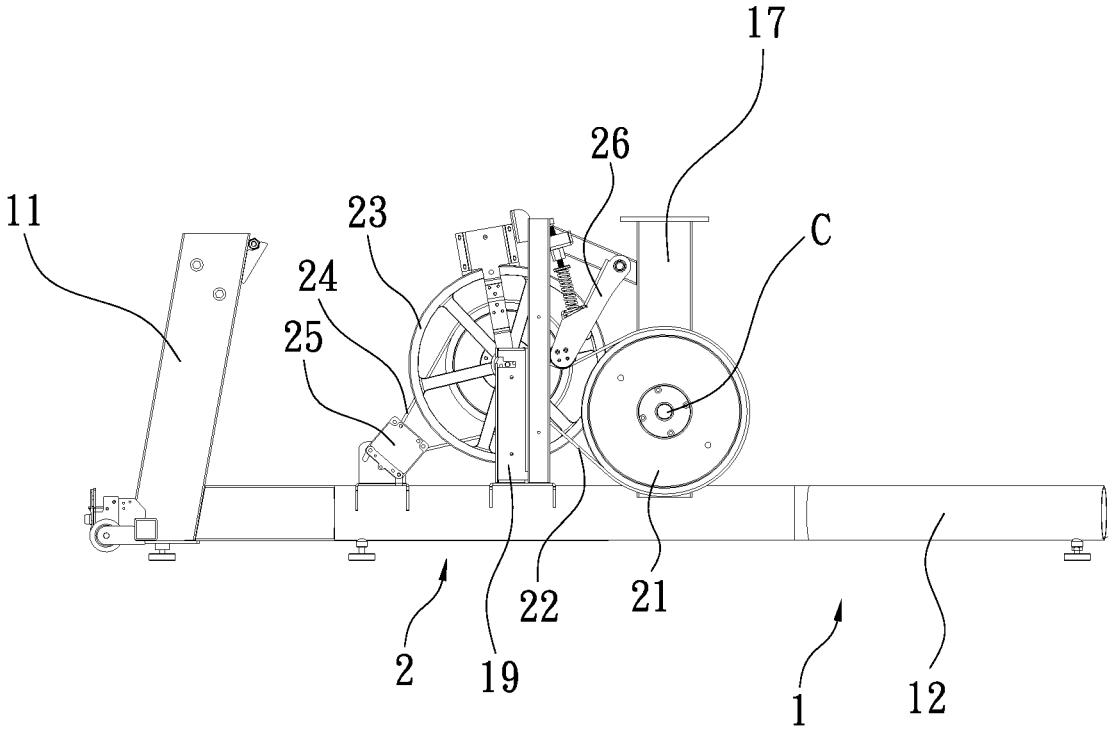
FIG. 4 shows a side view of the transmission unit mounted on the supportive frame.

Referring to FIGS. 3 and 4, the transmission unit 2 includes a first wheel 21, a first belt 22 made of cast steel, a second wheel 23, a second belt 24, an electrical generator 25, and an idler set 26. The first wheel 21 is rotatably mounted at the left post 17 of the supportive frame 1. The electrical generator 25 is provided on the base 10 of the supportive frame 1. The second wheel 23 is rotatably mounted at an upright brace 19 provided on the base 10 of the supportive frame 1. The first belt 22 is disposed around the first wheel 21 and a pulley mounted coaxially with the second wheel 23. The second belt 24 is disposed around another pulley mounted coaxially with the second wheel 23 and a pulley mounted at a driven axle of the electrical generator 25, so that the first wheel 21 can rotate the second wheel 23 which in turn rotates the electrical generator 25 to generate electricity for the control panel 110. The idler set 26 is forced to contact the first belt 22 to absorb vibrational energy so that noise level can be reduced and the life span of the exercise machine can be increased.

Figure 5:
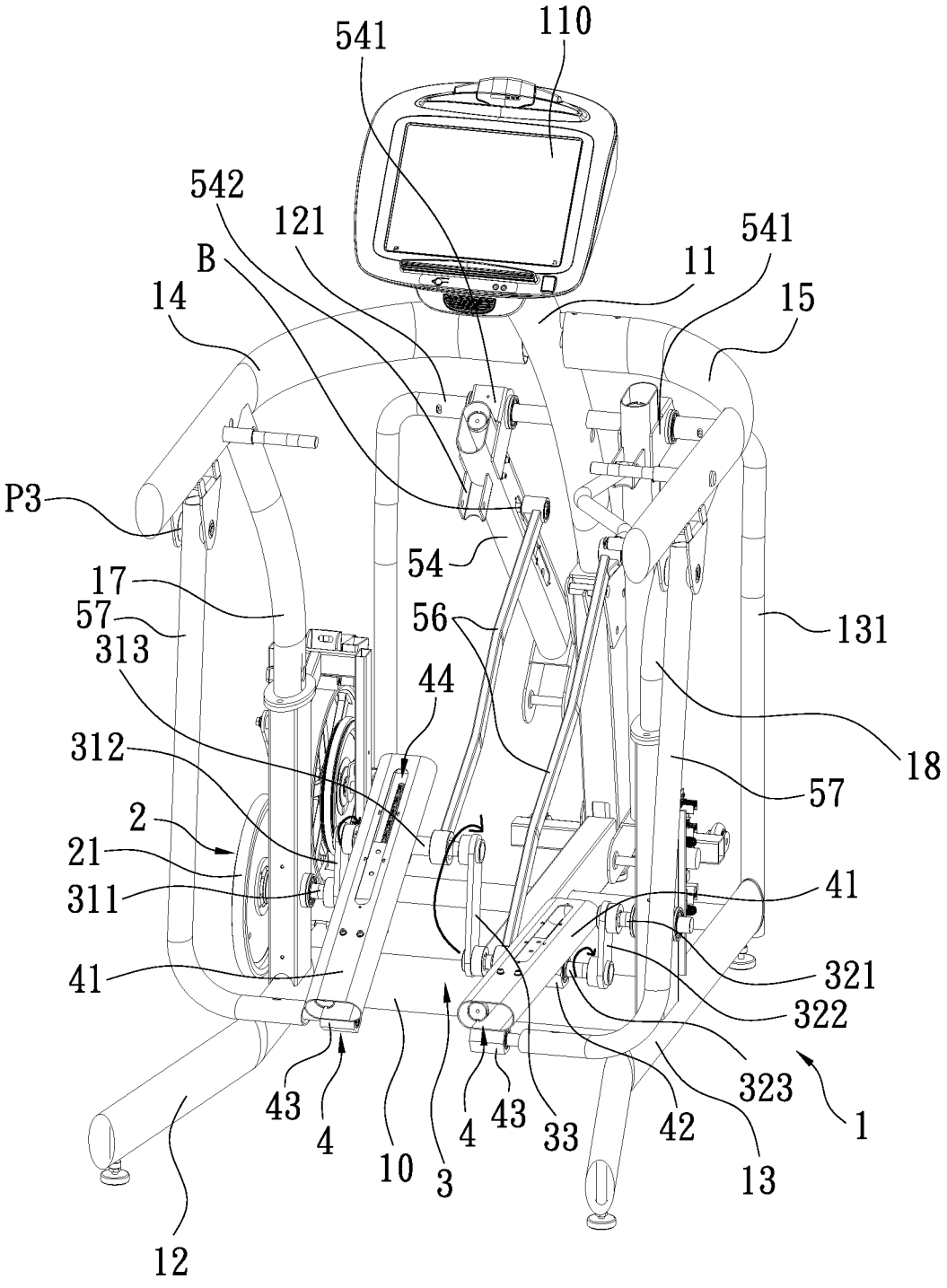
FIG. 5 shows a 3-dimensional view of a crank means used in the exercise machine.
Figure 6:
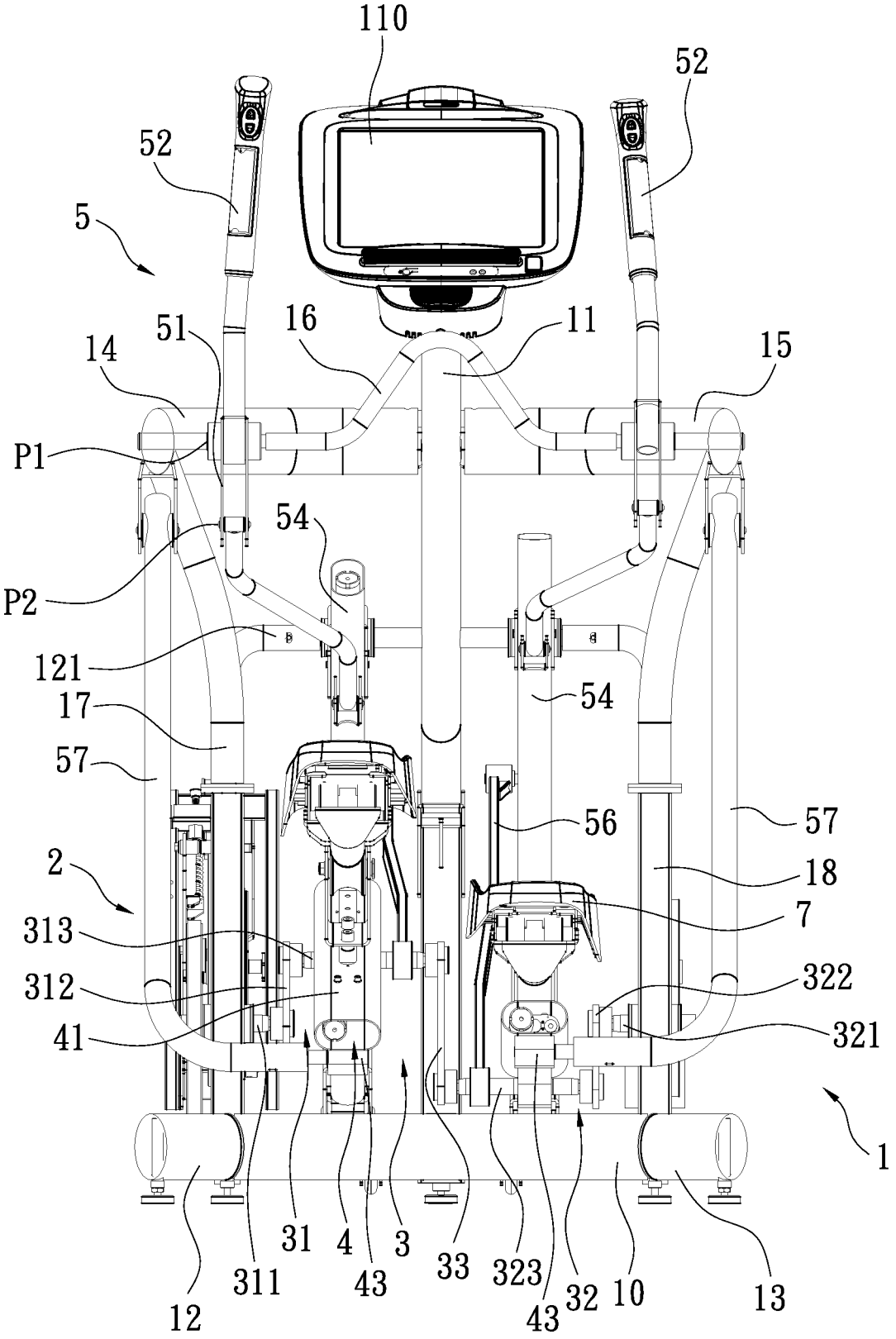
FIG. 6 shows a plan view of the crank means used in the exercise machine.

Referring to FIGS. 3, 5 and 6, the crank means 3 generally includes a left part 31, a right part 32, and an offset bar 33 joined between the left part 31 and the right part 32, wherein the left part 31 and the right part 32 are symmetrical about the center of the offset bar 33. Specifically, the left part 31 of the crank means 3 has a left main shaft 311, a left crank arm 312 formed at a right angle to the left main shaft 311, and a left crank pin 313 parallel to the left main shaft 311, wherein one end of the left main shaft 311 is inserted through the right post 17 and fixed to the center of the first wheel 21 while another end of the left main shaft 311 is fixed to one end of the left crank arm 312; another end of the left crank arm 312 is fixed to one end of the left crank pin 313. The right part 32 of the crank means 3 has a right main shaft 321 being coaxial with the left main shaft 311, a right crank arm 322 formed at a right angle to the right main shaft 321, and a right crank pin 323 parallel to right main shaft 321, wherein one end of the right main shaft 321 is rotatably mounted at the right post 18 while another end of the right main shaft 321 is fixed to one end of the right crank arm 322; another end of the right crank arm 322 is fixed to one end of the right crank pin 323; the offset bar 33 is joined between another end of the left crank pin 313 and another end of the right crank pin 323.

Figure 7:
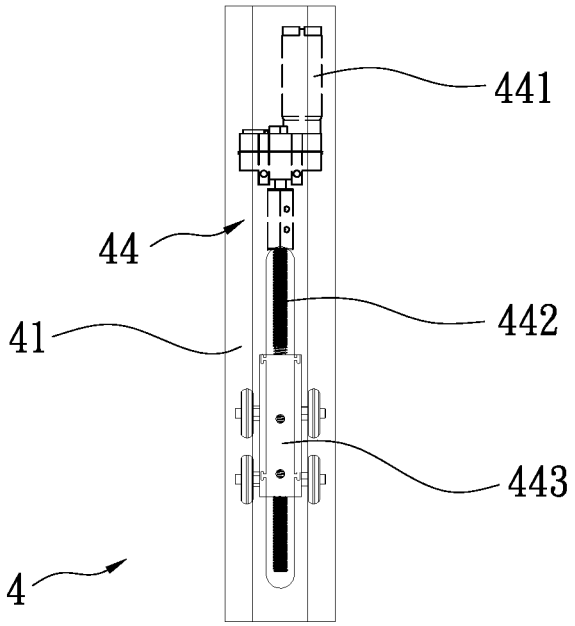
FIG. 7 shows a plan view of a first adjustment link used in the exercise machine, which includes therein a displacement tube.

Referring to FIGS. 2, 5 and 6, the first adjustment link 4 of each linkage unit 5 includes a hollow link body 41 formed with a front pivot 42 and a rear pivot 43 at its bottom, and provided thereon with a connection bracket 45 which has an upper roller 452 and a lower roller 451 and can be driven by a displacing device 44 to slide along the hollow link body 41 (see FIG. 7). The lower and upper rollers 451, 452 define a space 453 theretween, which is at a predetermined distance from the front pivot 42. The lower curved link 55 is inserted through the space 453 (see FIG. 9). As shown in FIG. 7, the displacing device 44 of the first adjustment link 4 includes a motor 441, a displacement tube 443, and a threaded rod 442 which extends from an axle of the motor 441 and can be driven by the motor 441. Also, the threaded rod 442 is in threaded engagement with the displacement tube 443, on which the connection bracket 45 is attached. The connection bracket 45 and the displacement tube 443 are attached at point (G). As such, the motor 441 can drive the displacement tube 443 together with the connection bracket 45 to move along the hollow link body 41, thus changing the position of point (G) (see FIG. 9). Also, the location of the space 453 defined between the upper roller 451 and the lower roller 452 can be changed by adjusting the position of point (G). The first adjustment link 4 is pivotally connected at its front pivot 42 to the crank means 3, wherein point (D) serves as a pivot center. More specifically, for the left linkage unit, the front pivot 42 of the first adjustment link 4 is in pivotal connection with the left crank pin 313 of the crank means 3; for the right linkage unit, the front pivot 42 of the first adjustment link 4 is in pivotal connection with the right crank pin 323 of the crank means 3. In addition, the first adjustment link 4 is pivotally connected at its rear pivot 43 to a lower end of the L-shaped rear link 57, wherein point (E) serves as a pivot center.

Figure 8:
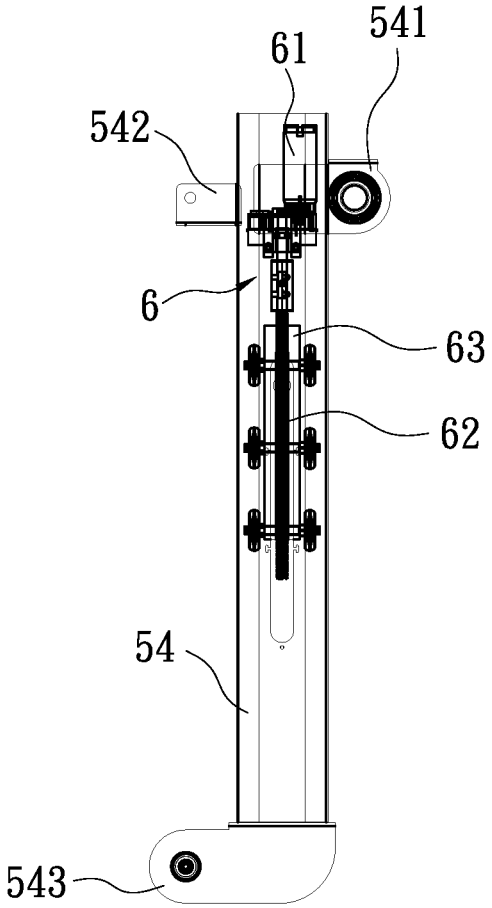
FIG. 8 shows a plan view of a second adjustment link used in the exercise machine, which includes therein a raising/lowering tube.
Figure 9:
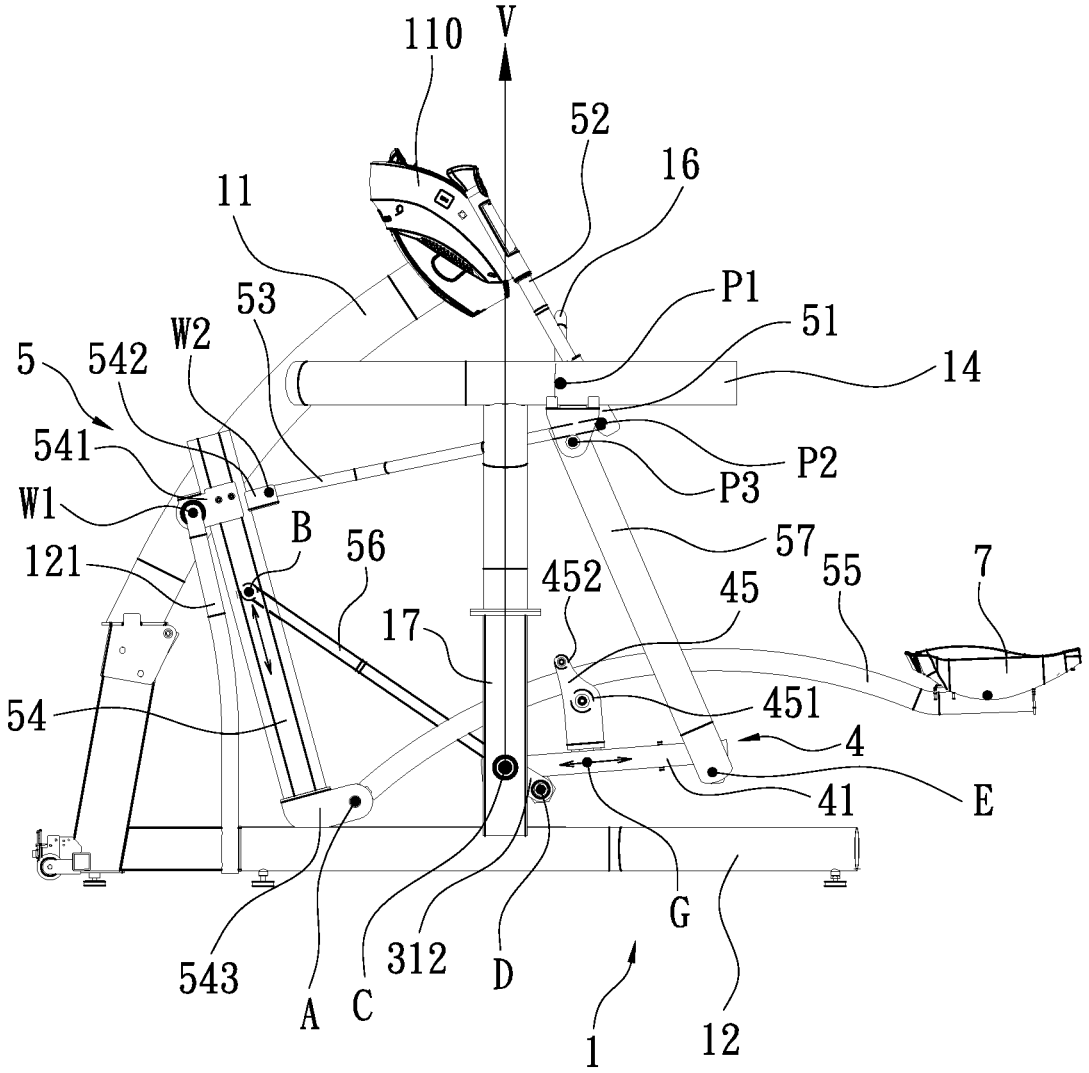
FIG. 9 shows a side view of the exercise machine.

Referring to FIGS. 1, 2 and 9, the rear link 57 is pivotally connected at its upper end to one of the curved bars 14, 15 of the supportive frame 1, wherein point (P3) serves as a pivot center. A lower end of the rear link 57 is in pivotal connection with the rear pivot 43 of the first adjustment link 4, wherein point (E) serves as a pivot center. The pivot block 51 is pivotally connected at a top pivot thereof about the transverse pole 16 of the supportive frame 1, wherein point (P1) serves as a pivot center. A rear end of the upper link 53 is in pivotal connection with a bottom pivot of the pivot block 51, wherein point (P2) serves as pivot center. A grip bar 52 is provided at a top of the pivot block 51, so that the grip bar 52 can be moved together with the pivot block 51 to swing about the top pivot of the pivot block 51. The second adjustment link 54 is pivotally connected at a first upper pivot 541 thereof to one of the L-shaped poles 121, 131 of the supportive frame 1, wherein point (W1) serves as a pivot center. A front end of the upper link 53 is in pivot connection with a second upper pivot 542 of the second adjustment link 54, wherein point (W2) serves as a pivot center opposite to the first upper pivot 541. A lower end or pivot 543 of the second adjustment link 54 is in pivotal connection with a front end of the lower curved link 55, wherein point (A) serves as a pivot center. A rear end of the lower curved link 55 is provided with a pedal 7. An upper end of the front link 56 is pivotally connected to a raising/lowering tube 63 provided in the second adjustment link 54, wherein point (B) serves as a pivot center (see FIG. 8). A lower end of the front link 56 is in pivotal connection with one of the left and right crank pins 313, 323 of the crank means 3, wherein point (D) serves as a pivot center.

Referring again to FIG. 9, the lower curved link 55 of each linkage unit 5 can be inserted through the space 453 defined between of the lower roller 451 and the upper roller 452 of the connection bracket 45, such that the lower curved tube 55 is in contact with the upper roller 452 and the lower roller 451, so that the lower and upper rollers 451, 452 can roll along the curved tube 55. In use, the pedal 7 of each linkage unit 5 can be stepped on to have the lower curved tube 55 slid between the upper and lower rollers 451, 452, and to have the crank means 3 turned to drive the transmission unit 2, wherein the motion path of the space 453 is non-circular.

Referring to FIGS. 2 and 8, the second adjustment link 54 includes therein a raising/lowering device 6, which includes a motor 61 and a threaded rod 62 extending from a driving axle of the motor 61. The threaded rod 62 is in engagement with the raising/lowering tube 63, which has a pivot, indicated by point (B), to be connected with the upper end of the front link 56 (see FIG. 9). As such, the motor 61 can rotate the threaded rod 62, which in turn moves the tube 63 along the second adjustment link 54, so that point (B) can be moved linearly along the second adjustment link 54, thus changing the position of point (B).

Referring again to FIG. 9, the center of the first wheel 21 is at point (C), which is also the center about which the crank means 3 is turned. The first upper pivot 541 of the second adjustment link 54 (i.e. point (W1)) and the top pivot of the pivot block 51 (i.e. point (P1)) of each linkage unit 5 are located respectively at two sides of a vertical axis (V) extending passing through the center (C) of the first wheel 21. The lower pivot 543 of the second adjustment link 54 (i.e. point (A)) and the pedal 7 are located respectively at two sides of the vertical axis (V). When a user steps on the pedals 7 to operate the exercise machine, as shown in FIG. 10, each pedal 7 performs a substantially elliptical closed path or trajectory (Y), which is ergonomical so that the user can be protected from exercise injury.

When a user wants to adjust the motion path (Y) of a pedal 7 or the force required for treading the pedal, the first adjustment link 4 and/or the second adjustment link 54 can be adjusted in length, as shown in FIGS. 9 through 14.

Figure 10:
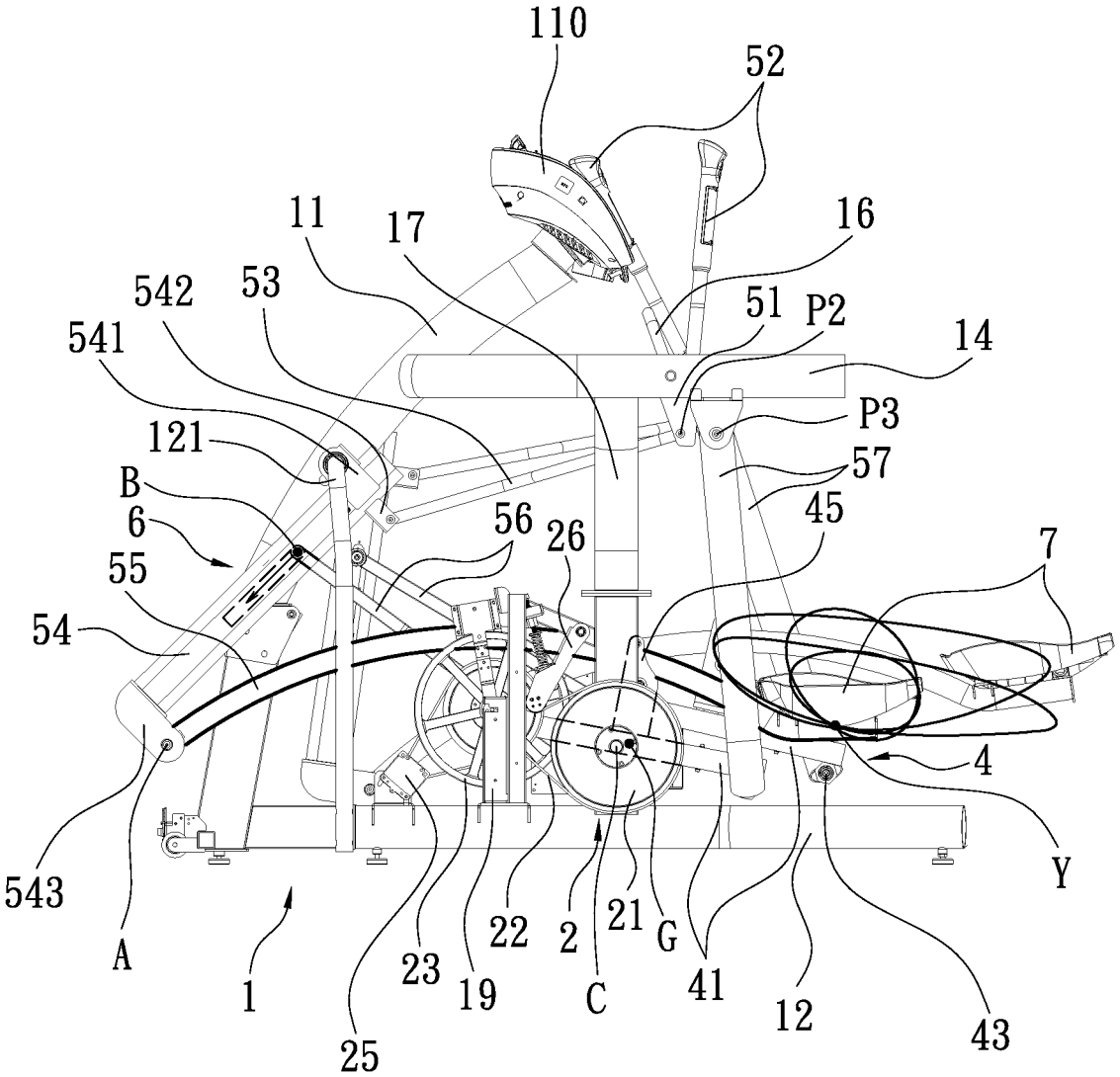
FIG. 10 shows a schematic view of the exercise machine, wherein a plurality of trajectories, corresponding to adjustments of the raising/lowering tube within the second adjustment link and the displacement tube within the first adjustment link, can be performed by a pedal thereof.
Figure 11:
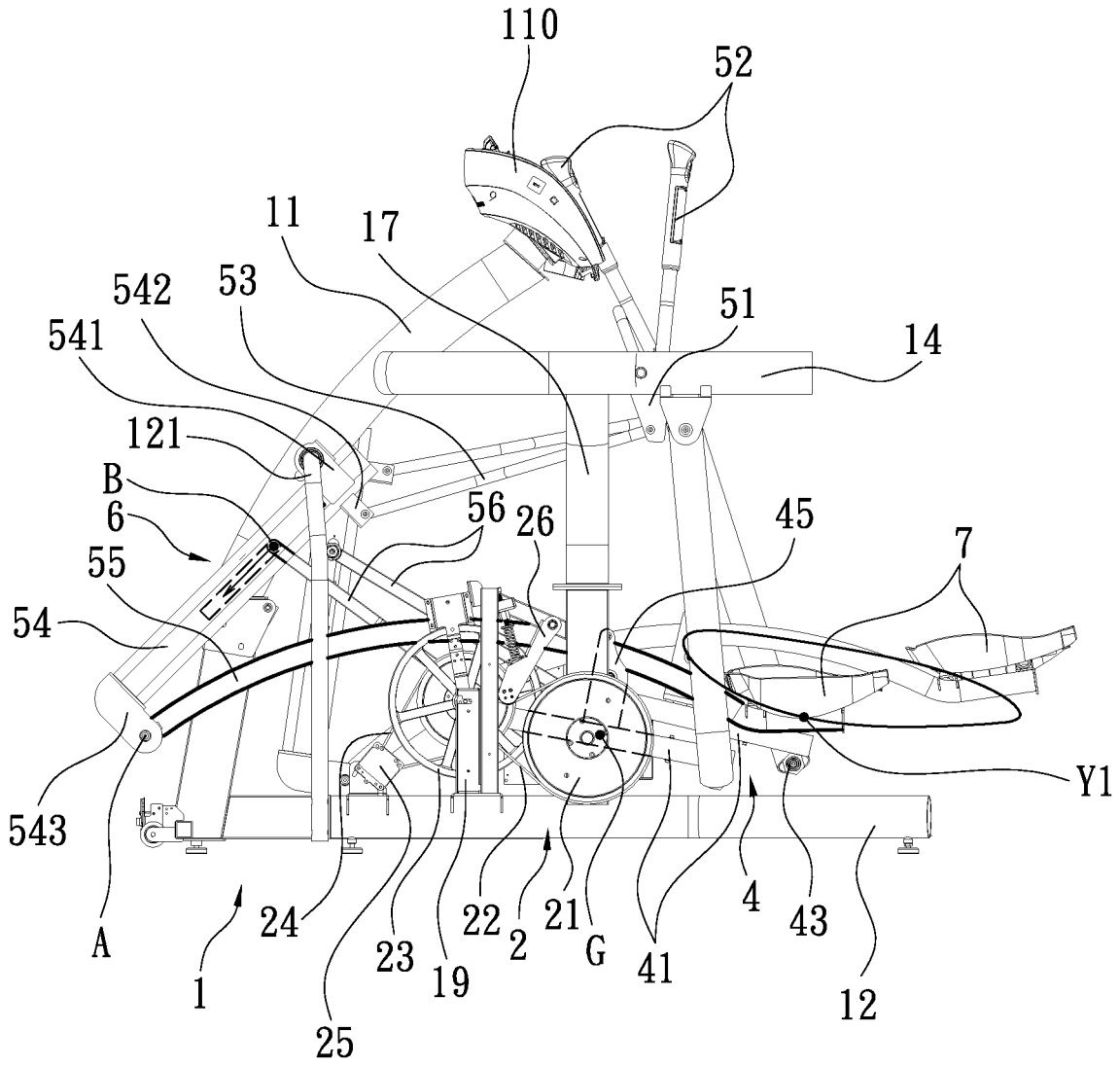
FIG. 11 shows a schematic view of the exercise machine, wherein the pedal can be moved along a trajectory by adjusting the raising/lowering tube to a highest position and adjusting the displacement tube to a rearmost position.
Figure 12:
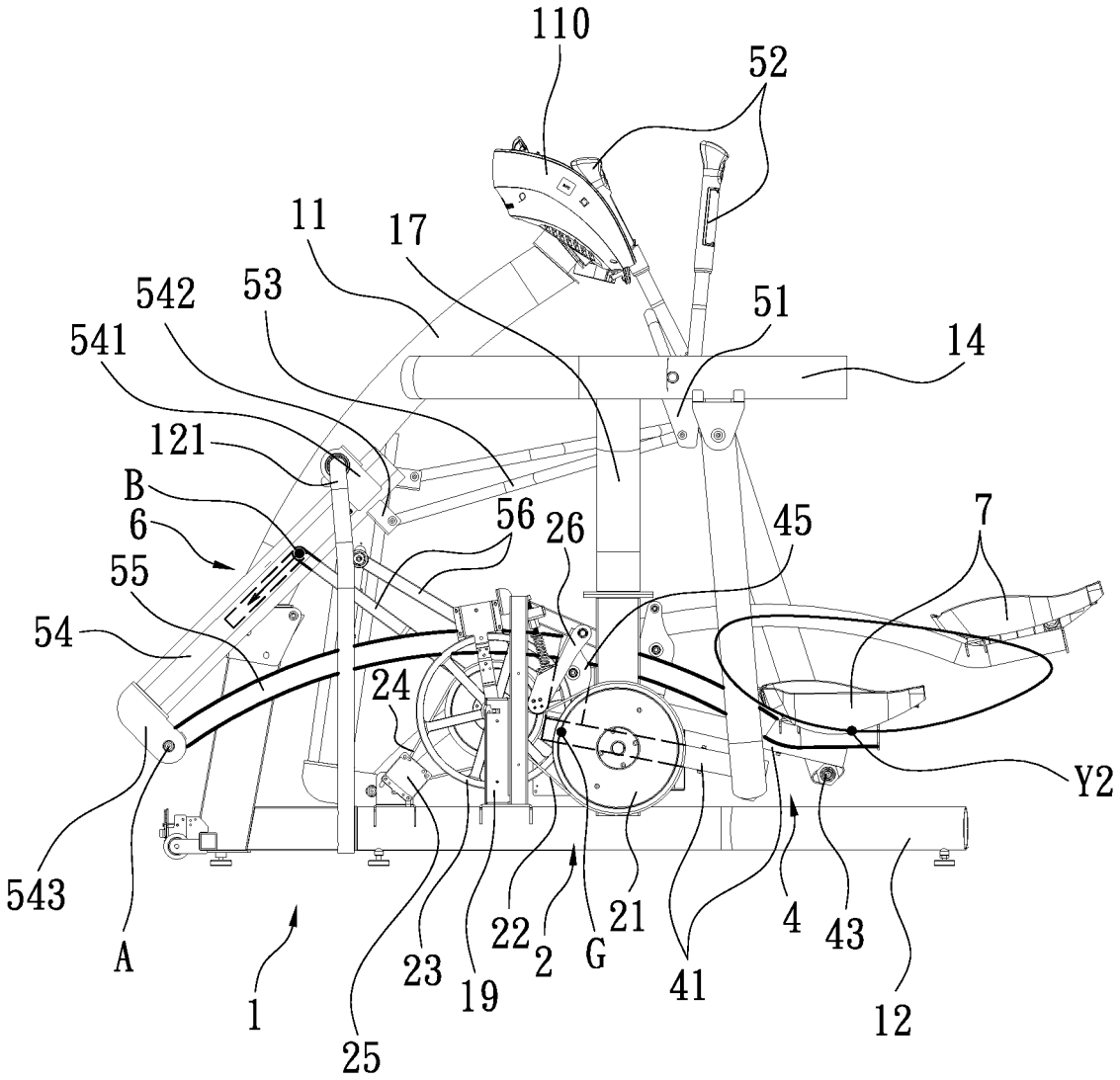
FIG. 12 shows a schematic view of the exercise machine, wherein the pedal can be moved along a trajectory by adjusting the raising/lowering tube to a highest position and adjusting the displacement tube to a frontmost position.
Figure 13:
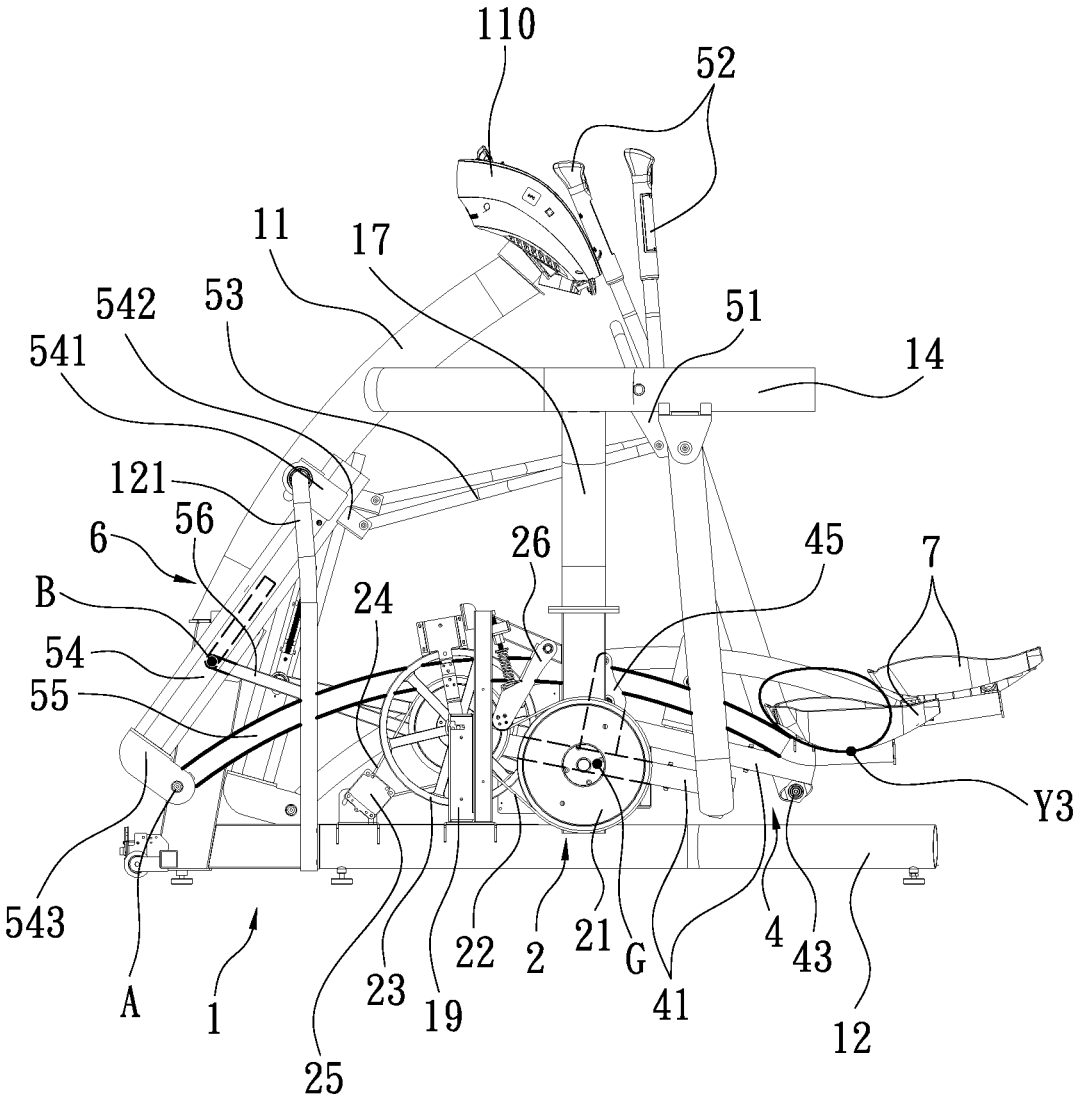
FIG. 13 shows a schematic view of the exercise machine, wherein the pedal can be moved along a trajectory by adjusting the raising/lowering tube to a lowest position and adjusting the displacement tube to a rearmost position.
Figure 14:
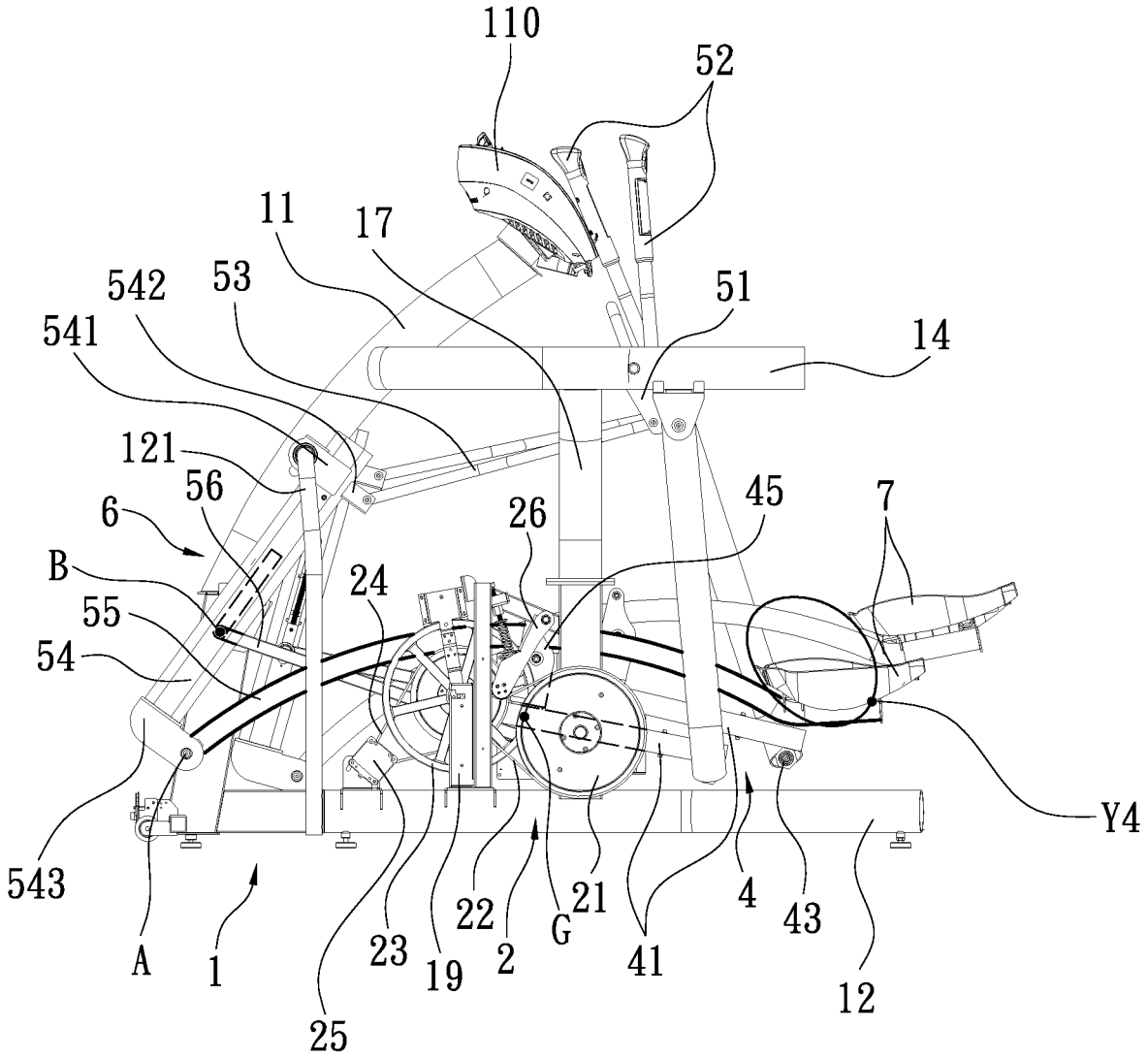
FIG. 14 shows a schematic view of the exercise machine, wherein the pedal can be moved along a trajectory by adjusting the raising/lowering tube to a lowest position and adjusting the displacement tube to a frontmost position.

Referring to FIGS. 10, 11 and 12, when point (B) of the raising/lowering tube 63 is moved to a highest position, the trajectory performed by each pedal 7 requires a user to take a big step and a big treading force. The trajectory, which is a substantially elliptical closed path, can be finely adjusted by changing the first adjustment link 4. When point (G) is adjusted to the rearmost position, as shown in FIG. 11, each pedal 7 performs an elliptical closed path (Y1). When point (G) is adjusted to the frontmost position, as shown in FIG. 12, each pedal 7 performs an elliptical closed path (Y2), which has a minor axis greater than the elliptical path (Y1) shown in FIG. 11. When point (B) of the raising/lowering tube 63 is moved to a lowest position, as shown in FIGS. 13 and 14, the trajectory performed by each pedal 7 is a substantially elliptical closed path which is tilted up at its front and requires a user to take a small step. This trajectory allows a user to feel like climbing a flight of steps. The trajectory can be finely adjusted by the first adjustment link 4. When point (G) is adjusted to the rearmost position, as shown in FIG. 13, each pedal 7 performs an elliptical closed path (Y3). When point (G) is adjusted to the frontmost position, as shown in FIG. 14, each pedal 7 performs an elliptical closed path (Y4), which has a minor axis greater than the elliptical path (Y3) as shown in FIG. 13.

As a summary, the exercise machine of the present invention allows a user to change the configuration of linkage units 5 through the raising/lowering device 6 provided in the second adjustment link 54 and the displacing device 44 provided in the first adjustment link 4, so that a desired movement or exercise mode can be obtained. In particular, each pedal 7 can perform a substantially elliptical closed path, which is ergonomical so that the user can be protected from exercise injury.

While the invention has been described with reference to the preferred embodiments above, it should be recognized that the preferred embodiments are given for the purpose of illustration only and are not intended to limit the scope of the present invention and that various modifications and changes, which will be apparent to those skilled in the relevant art, may be made without departing from the scope of the invention.

What is claimed is:

1. A composite motion exercise machine, comprising:

a supportive frame placed on a floor or ground;

a transmission unit including a first wheel rotatably mounted at the supportive frame and an electrical generator provided at the supportive frame and driven by the first wheel;

a crank means including a left part, a right part, and an offset bar joined between an inner end of the left part and an inner end of the right part, the left part and the right part being symmetrical about a center of the offset bar, an outer end of the left part being fixed to a center of the first wheel, an outer end of the right part being rotatably connected at the supportive frame; and a pair of linkage units, each including a first adjustment link, a second adjustment link, a front link, a rear link, an upper link, a lower curved link, and a pivot block, wherein the first adjustment link includes a hollow link body formed thereunder with a front pivot and a rear pivot, and provided thereon with a connection bracket having a lower roller and an upper roller and capable of being driven by a displacing device to slide along the hollow link body, the lower and upper rollers defining a space theretween, which is at a predetermined distance from the front pivot and through which the lower curved link is inserted, the front pivot of the first adjustment link pivotally connected to the crank means, the rear pivot of the first adjustment link pivotally connected to a lower end of the rear link, an upper end of the rear link pivotally connected to the supportive frame, a rear end of the upper link pivotally connected to a bottom pivot of the pivot block which is pivotally connected at a top pivot thereof to the supportive frame, the second adjustment link pivotally connected at a first upper pivot thereof to the supportive frame, a front end of the upper link pivotally connected to a second upper pivot of the second adjustment link, a lower end of the second adjustment link pivotally connected to a front end of the lower curved link, a rear end of the lower curved link provided with a pedal, an upper end of the front link pivotally connected to a raising/lowering tube provided in the second adjustment link, a lower end of the front link pivotally connected to the crank means;

whereby when a user steps on the pedals to exercise, each pedal performs a substantially elliptical closed path which is ergonomical, so that the user can be protected from exercise injury.

2. The composite motion exercise machine of claim 1, wherein the supportive frame is constructed of a base, a front post extending upwardly from the base, two rearward extension bars extending rearwardly from the base, a pair of curved bars extending rearwardly from the front post and located at a predetermined height from the base, left and right posts extending upwardly from the base to respectively joined to the pair of curved bars, a pair of L-shaped poles extending upwardly from the base and joined to the front post, and a transverse pole joined between the pair of curved bars; the pivot block of each linkage is pivotally connected at its top pivot about the transverse pole; the second adjustment link of each linkage is pivotally connected at its first upper pivot about one of the pair of the L-shaped poles; the first wheel is rotatably mounted at the left post, the outer end of the right part of the crank means is rotatably connected at the right post; the rear link of each linkage is pivotally connected at its upper end to one of the pair of the curved bars; a control panel is provided on top of the front post.

3. The composite motion exercise machine of claim 2, wherein the transmission unit further includes a first belt, a second wheel made of cast steel, a second belt, and an idler set, the second wheel being rotatably mounted at an upright brace provided on the base of the supportive frame, the electrical generator provided at the base of the supportive frame; the first belt being disposed around the first wheel and a pulley mounted coaxially with the second wheel, the second belt being disposed around another pulley mounted coaxially with the second wheel and a pulley mounted at an driven axle of the electrical generator so that the first wheel can rotate the second wheel which in turn rotates the electrical generator to generate electricity, the idler set being forced to contact the first belt to absorb vibrational energy so that noise level can be reduced and the life span of the exercise machine can be increased.

4. The composite motion exercise machine of claim 2, wherein the left part of the crank means has a left main shaft, a left crank arm formed at a right angle to the left main shaft, and a left crank pin parallel to the left main shaft, one end of the left main shaft being inserted through the left post and fixed to the center of the first wheel, another end of the left main shaft being fixed to one end of the left crank arm, another end of the left crank arm being fixed to one end of the left crank pin; the right part of the crank means has a right main shaft being coaxial with the left main shaft, a right crank arm formed at a right angle to the right main shaft, and a right crank pin parallel to right main shaft, one end of the right main shaft being rotatably mounted at the right post, another end of the right main shaft being fixed to one end of the right crank arm, another end of the right crank arm being fixed to one end of the right crank pin; the offset bar is joined between another end of the left crank pin and another end of the right crank pin; the front pivot of the first adjustment link is pivotally connected to one of the left and right crank pins of the crank means; whereby each linkage may turn the crank means to drive the transmission unit.

5. The composite motion exercise machine of claim 2, wherein the displacing device of the first adjustment link includes a motor, a displacement tube, and a threaded rod rotated by the motor and being in threaded engagement with the displacement tube on which the connection bracket is provided, whereby the motor can move the displacement tube together with the connection bracket along the hollow link body, thus changing the location of the space defined between the lower roller and the upper roller.

6. The composite motion exercise machine of claim 2, wherein the rear link of each linkage is L-shaped; a grip bar is provided at a top of the pivot block, so that the grip bar allows to be moved together with the pivot block to swing about the top pivot of the pivot block; the second adjustment link includes therein a raising/lowering device including a motor, a raising/lowering tube, and a threaded rod rotated by the motor and being in threaded engagement with the raising/lowering tube which is pivotally connected to the upper end of the front link; the first upper pivot of the second adjustment link and the top pivot of the pivot block of each linkage unit are located respectively at two sides of a vertical axis extending passing through the center of the first wheel; the lower end of the second adjustment link and the pedal are located respectively at two sides of the vertical axis.

* * * * *